US009457357B2

(12) United States Patent
Martins

(10) Patent No.: US 9,457,357 B2
(45) Date of Patent: Oct. 4, 2016

(54) MIXED COLLECTOR COMPOSITIONS

(71) Applicant: Georgia-Pacific Chemicals LLC, Atlanta, GA (US)

(72) Inventor: Luiz Henrique Martins, Jundiai (BR)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 195 days.

(21) Appl. No.: 14/088,585

(22) Filed: Nov. 25, 2013

(65) Prior Publication Data

US 2014/0144290 A1 May 29, 2014

Related U.S. Application Data

(60) Provisional application No. 61/730,754, filed on Nov. 28, 2012.

(51) Int. Cl.
*B03D 1/02* (2006.01)
*B03D 1/01* (2006.01)

(52) U.S. Cl.
CPC . *B03D 1/01* (2013.01); *B03D 1/02* (2013.01); *B03D 2201/02* (2013.01); *B03D 2203/02* (2013.01)

(58) Field of Classification Search
CPC ..... B03D 1/01; B03D 1/02; B03D 2201/02; B03D 2203/02
See application file for complete search history.

(56) References Cited

U.S. PATENT DOCUMENTS

| | | | | |
|---|---|---|---|---|
| 2,356,821 A * | 8/1944 | Christmann | ..... | B03D 1/01 209/166 |
| 3,363,758 A * | 1/1968 | Cronberg | ..... | B03D 1/01 209/166 |
| 2014/0048454 A1* | 2/2014 | Birken | ..... | B03D 1/01 209/166 |

FOREIGN PATENT DOCUMENTS

| | | |
|---|---|---|
| WO | 2009097562 A1 | 8/2009 |
| WO | 2012139986 A2 | 10/2012 |

* cited by examiner

*Primary Examiner* — Thomas M Lithgow
(74) *Attorney, Agent, or Firm* — Ram W. Sabnis

(57) ABSTRACT

Collector compositions and methods for making and using same are provided. The collector can include one or more etheramines and one or more amidoamines. A liquid suspension or slurry comprising one or more particulates can be contacted with the collector to produce a treated mixture. A product can be recovered from the treated mixture that includes a purified liquid having a reduced concentration of the particulates relative to the treated mixture, a purified particulate product having a reduced concentration of liquid relative to the treated mixture, or both.

20 Claims, No Drawings

MIXED COLLECTOR COMPOSITIONS

CROSS-REFERENCE TO RELATED APPLICATION

This application claims priority to U.S. Provisional Patent Application having Ser. No. 61/730,754, filed Nov. 28, 2012, which is incorporated by reference herein.

BACKGROUND

1. Field

Embodiments described herein generally relate to collector compositions and methods for using same to recover one or more purified materials. More particularly, such embodiments relate to collector compositions that include one or more etheramines and one or more amidoamines and an inverted froth flotation process for using the collector compositions to enrich an iron mineral from a silicate-containing iron ore.

2. Description of the Related Art

Froth flotation is a physiochemical mineral concentration method that uses the natural and/or created differences in the hydrophobicity of the minerals to be separated. To enhance an existing or to create new water repellencies on the surface of the minerals, certain heteropolar or nonpolar chemicals called collectors are added to an aqueous slurry containing the mineral(s) to be separated or purified. These chemicals are designed to selectively attach to one or more of the minerals to be separated, forming a hydrophobic monolayer on their surfaces. The formation of the hydrophobic monolayer makes the minerals more likely to attach to air bubbles upon collision. The mass of the combined air bubble/mineral particles is less dense than the displaced mass of the pulp, which causes the air bubble/mineral particles to float to the surface where they form a mineral-rich froth that can be skimmed off from the flotation unit, while the other minerals remain submerged in the pulp. The flotation of minerals with a negative surface charge, such as silica, silicates, feldspar, mica, clays, chrysocola, potash and others, from a pulp can be achieved using cationic collectors. In iron and phosphate beneficiation processes the impurities are typically floated away, leaving the valuable component behind. This process is called "reverse flotation." Cationic collectors are organic molecules that have a positive charge when in an aqueous environment. Typically cationic collectors will have a nitrogen group with unpaired electrons present.

In reverse flotation, impurities are floated out of the mineral of value. In particular, iron ore, calcium carbonate, phosphate, and feldspar are frequently beneficiated in this manner. In many cases minerals containing silicate are the main components of these impurities which cause quality reductions in the end product. The minerals containing silicate include quartz, mica, feldspar, muscovite, and biotite. A high silicate content lowers the quality of iron ore concentrate, which in Brazil, for example, is purified via flotation using alkyl ether amines and alkyl ether diamines so that high-grade steels can be produced from the low-silicate concentrate. The collectors for silicate flotation which are described in the prior art, however, exhibit inadequate results with respect to selectivity and yield.

There is a need, therefore, for improved collector compositions and uses thereof in ore beneficiation processes.

SUMMARY

Collector compositions and methods for making and using same are provided. In at least one specific embodiment, the method for beneficiation of an ore can include contacting a liquid suspension or slurry that includes one or more particulates with a collector to produce a treated mixture. The collector can include one or more amidoamines having formula (I):

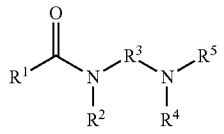

(I)

where $R^1$ can be a $(C_1\text{-}C_{24})$alkyl, a $(C_1\text{-}C_{24})$alkenyl, or a $(C_1\text{-}C_{24})$dialkenyl; $R^2$ and $R^3$ can independently be selected from a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, and an aryl substituted by one or more substituents selected from halogens, $(C_1\text{-}C_6)$alkyls, and halogen-$(C_1\text{-}C_6)$alkyls; and $R^4$ and $R^5$ can be independently selected from a hydrogen and a $(C_1\text{-}C_6)$alkyl, and one or more etheramines having formula (II):

$$R^6\text{—}O\text{—}R^7\text{—}NH_2 \quad \text{(II)}$$

where $R^6$ can be a hydrogen, a $(C_1\text{-}C_{18})$alkyl, a halogen-$(C_1\text{-}C_{18})$alkyl, a phenyl, a $(C_1\text{-}C_6)$alkenyl, a heterocyclyl, an unsubstituted aryl, or an aryl substituted by one or more substituents selected from halogens, $(C_1\text{-}C_{18})$alkyls, and halogen-$(C_1\text{-}C_{18})$alkyls; and $R^7$ can be a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, or an aryl substituted by one or more substituents selected from halogens, $(C_1\text{-}C_6)$alkyls, and halogen-$(C_1\text{-}C_6)$alkyls, or one or more etheramines having formula (III):

$$R^8\text{—}O\text{—}R^9\text{—}NH\text{—}R^{10}\text{—}NH_2 \quad \text{(III)}$$

where $R^8$ can be a hydrogen, a $(C_1\text{-}C_{18})$alkyl, a halogen-$(C_1\text{-}C_{18})$alkyl, a phenyl, a $(C_1\text{-}C_{18})$alkenyl, a heterocyclyl, an unsubstituted aryl, or an aryl substituted by one or more substituents selected from halogens, $(C_1\text{-}C_{18})$alkyls, and halogen-$(C_1\text{-}C_{18})$alkyls; and $R^9$ and $R^{10}$ can independently be selected from a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, and an aryl substituted by one or more substituents selected from halogens, $(C_1\text{-}C_6)$alkyls, and halogen-$(C_1\text{-}C_6)$alkyls, where a weight ratio of the amidoamine to the etheramine can be from about 99:1 to about 1:99. The method can also include recovering from the treated mixture a product that includes a purified liquid having a reduced concentration of the particulates relative to the treated mixture, a purified particulate product having a reduced concentration of liquid relative to the treated mixture, or both. In at least one specific embodiment, the method can further include passing air through the treated mixture.

In at least one other specific embodiment, the method for beneficiation of an ore can include contacting an aqueous suspension or slurry comprising one or more contaminants and one or more value materials with a collector composition to provide a treated mixture. The collector can include one or more amidoamines having formula (I):

(I)

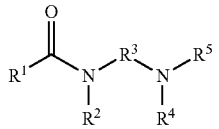

where $R^1$ can be a $(C_1-C_{24})$alkyl, a $(C_1-C_{24})$alkenyl, or a $(C_1-C_{24})$dialkenyl; $R^2$ and $R^3$ can independently be selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls; and $R^4$ and $R^5$ can be independently selected from a hydrogen and a $(C_1-C_6)$alkyl, and one or more etheramines having formula (II):

$$R^6O—R^7—NH_2 \quad (II)$$

where $R^6$ can be a hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^7$ can be a hydrogen, a $(C_1-C_6)$alkyl, a halogen-$(C_1-C_6)$alkyl, a phenyl, a $(C_1-C_6)$alkenyl, a heterocyclyl, an unsubstituted aryl, or an aryl substituted by one or more substituents selected from halogens, $(C_1-C_6)$alkyls, and halogen-$(C_1-C_6)$alkyls, or one or more etheramines having formula (III):

$$R^8—O—R^9—NH—R^{10}NH_2 \quad (III)$$

where $R^8$ can be a hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^9$ and $R^{10}$ can independently be selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls, where a weight ratio of the amidoamine to the etheramine can be from about 99:1 to about 1:99. The method can also include passing air through the treated mixture and recovering from the treated mixture a product comprising the value material having a reduced concentration of the contaminant relative to the treated mixture.

DETAILED DESCRIPTION

It has been surprisingly and unexpectedly discovered that using a collector composition containing a combination of one or more amidoamines and one or more etheramines in a separation process for the purification of iron containing ores yields a greater recovery of iron as compared to using a collector that contains the amidoamine or the etheramine alone. The collector can be mixed, blended, or otherwise contacted with a particulate or solids containing aqueous suspension or slurry to produce a treated mixture. The combination of the etheramine and the amidoamine can provide a good selectivity and a high yield of the silicate in the flotate, while the bottom fraction contains the iron mineral in a high yield and low silicate content. For example, the collector containing both the amidoamine and the etheramine can increase the recovery of iron as compared to using a collector that contains only the etheramine alone by about 0.2%, about 0.5%, about 1%, about 2%, about 3%, about 4%, about 5%, about 6%, about 7%, or more. In another example, the collector containing both the amidoamine and the etheramine can increase the recovery of iron as compared to using a collector that contains only the amidoamine alone by about 0.5%, about 1%, about 2%, about 3%, about 4%, about 5%, about 6%, about 7%, or more. The separation process can be or include froth flotation, inverted or reverse froth flotation, coagulation, flocculation, filtration, and/or sedimentation.

The amidoamine can have the formula:

(Formula I)

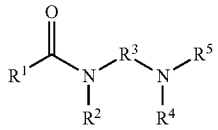

where $R^1$ can be selected from $(C_1-C_{24})$alkyls, $(C_1-C_{24})$alkenyls, and $(C_1-C_{24})$dialkenyls; $R^2$ and $R^3$ can be independently selected from hydrogen, $(C_1-C_6)$alkyls, halogen-$(C_1-C_6)$alkyls, phenyl, $(C_1-C_6)$alkenyls, heterocyclyls, unsubstituted aryls, and aryls substituted by one or more substituents selected from halogens, $(C_1-C_6)$alkyls, and halogen-$(C_1-C_6)$alkyls; and $R^4$ and $R^5$ can be independently selected from hydrogen, $(C_1-C_6)$alkyls, and $(C_1-C_6)$alkyls substituted by one or more substituents selected from halogens, $(C_1-C_6)$alkyls, and halogen-$(C_1-C_6)$alkyls.

Examples of $(C_1-C_{24})$alkyls can include, but are not limited to, branched and straight-chain monovalent saturated aliphatic hydrocarbon radicals containing one to twenty-four carbon atoms, e.g., methyl, ethyl, propyl, isopropyl, butyl, isobutyl, tert-butyl, the isomeric pentyls, the isomeric hexyls, pentadecyl, hexadecyl, heptadecyl, octadecyl, nondecyl, eicosyl, henicosyl, docosyl, tricosyl. Illustrative examples of heterocycle groups can include, but are not limited to, a heteroaryl group such as pyridinyl, pyridazinyl, pyrimidinyl, thiazolyl, oxazolyl, isothiazolyl, isoxazolyl, thiophenyl, furanyl, pyrazolyl, indolyl, benzo[b]thiophenyl, 4,5,6,7-tetrahydro-benzo[b]thiophenyl, benzofuranyl, 4,5,6,7-tetrahydro-benzothiazolyl, aminopyridinyl, aminopyridazinyl, aminopyrimidinyl, aminothiophenyl, aminopyrazolyl, aminothiazolyl, aminoisothiazolyl, aminoisoxazolyl, 2-aminopyridin-3-yl, 3-aminopyridin-2-yl, 4-aminopyridin-3-yl, 3-aminopyridin-4-yl, 3-amino-pyridazin-2-yl, 4-aminopyridazin-3-yl, 5-aminopyridazin-4-yl, 3-aminopyridazin-4-yl, 4-amino-pyrimidin-5-yl, 5-aminopyrimidin-4-yl, 5-aminothiazol-4-yl, 5-aminoisothiazol-4-yl and 3-aminoisoxazol-4-yl, 2-aminothiophen-3-yl, 3-aminothiophen-2-yl, 3-aminothiophen-4-yl, 5-aminopyrazol-4-yl. The heterocycle group can be unsubstituted or substituted by one to three substituents selected from halogen, alkyl, halogenalkyl, and cycloalkyl, which can again be unsubstituted or substituted by one or more of the above mentioned substituents.

$R^2$ and $R^3$ can be joined or bonded to one another to form a $(C_4-C_{10})$alkylene link, with the link optionally incorporating 1 or 2 heteroatoms each independently selected from N, O, and S. For example, the 4- to 10-membered cyclic amino group means a cyclic amino group that can contain a nitrogen atom, an oxygen atom, and/or a sulfur atom. Illustrative examples of amino groups can include, but are not limited to, a pyrrolidino group, a piperidino group, a piperazino group, an N-methylpiperazino group, an N-phenylpiperazino group, a morpholino group, a thiomorpholino group, a hexamethyleneimino group, a 3,3,5-trimethylhexahydroazepino group, and the like. The cyclic amino group can also form a quaternary base further substituted with a ($C_1$-$C_6$)alkyl group, a substituted ($C_1$-$C_6$)alkyl group, an aralkyl group or a substituted aralkyl group. Examples can include, but are not limited to, a methylpyrrolidinium base, a methylpiperidinium base, a methylmorpholinium base, and the like.

As depicted in Formula I, $R^4$ and $R^5$ are bonded to nitrogen and compose an amino group. The amino group can be a primary amino group, a secondary amino group, or a tertiary amino group. $R^4$ and $R^5$ can be joined or bonded to one another to form a ($C_4$-$C_{10}$)alkylene link, with the link optionally incorporating 1 or 2 heteroatoms each independently selected from N, O, and S. For example, the 4- to 10-membered cyclic amino group means a cyclic amino group that can contain a nitrogen atom, an oxygen atom, and/or a sulfur atom. Illustrative examples can include a methylamino group, a dimethylamino group, an ethylamino group, a diethylamino group, a methylethylamino group, a propylamino group, a dipropylamino group, an isopropylamino group, a diisopropylamino group, a butylamino group, a dibutylamino group, and the like. The amino group substituted with two groups selected from ($C_1$-$C_6$)alkyl groups can be further substituted with a ($C_1$-$C_6$)alkyl group, a substituted ($C_1$-$C_6$)alkyl group, an aralkyl group or a substituted aralkyl group.

The amidoamine can be synthesized by reacting one or more carboxylic acids and/or one or more carboxylic acid derivatives with a polyamine via a condensation reaction. An illustrative condensation reaction of a carboxylic acid and a polyamine can be as depicted in Reaction I.

(Reaction I)

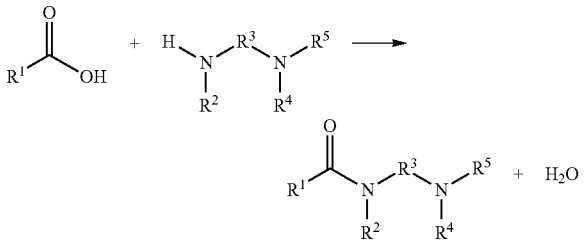

The carboxylic acid undergoes nucleophilic attack by the amine. The nucleophilic attack can take place through any of the polyamine's amino groups; however, the amino groups that have different neighboring groups will have different chemoselectivity with respect to the other amino groups.

The carboxylic acid derivative reactant can have the formula:

(Formula II)

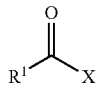

where $R^1$ can be as discussed and described above with respect to Formula I and X is hydroxyl. The carboxylic acid can be hydrolyzed to form a carboxylate salt where X is OLi, ONa, or OK. The carboxylic acid can be a carboxylic acid derivative, such as an acyl chloride where X is Cl. The X can also be OR, where R is a ($C_1$-$C_6$)alkyl making the compound of formula II an ester.

The carboxylic acid reactants can be or include a fatty acid, a mixture of fatty acids, a fatty acid ester, a mixture of fatty acid esters, or a mixture of one or more fatty acids and one or more fatty acid esters. The carboxylic acid can be or include one or more tall oil fatty acids. As used herein, "tall oil fatty acids" or "TOFA," consistent with industry standards, encompasses compositions which include not only fatty acids, but also rosin acids and/or unsaponifiables. TOFAs are generally produced as a distillation fraction of crude tall oil and therefore contain a mixture of saturated and unsaturated fatty acids, rosin acids, and mixtures thereof. Representative fatty acids include oleic acid, lauric acid, linoleic acid, linolenic acid, palmitic acid, stearic acid, ricinoleic acid, myristic acid, arachidic acid, behenic acid and mixtures thereof. As recognized by those skilled in tall oil chemistry, the actual distribution of these three major constituents in a crude tall oil depends on a variety of factors, such as the particular coniferous species of the wood being processed (wood type), the geographical location of the wood source, the age of the wood, the particular season that the wood is harvested, and others. Thus, depending on the particular source, crude tall oil can contain from about 20 wt % to about 75 wt % fatty acids (more often 30-60%), from about 20 wt % to about 65 wt % rosin acids, and 1 wt % to about 40 wt % neutral and non-saponifiable components. For example, crude tall oil can have a fatty acids concentration of about 30 wt % to about 60 wt %, a rosin acids concentration of about 30 wt % to about 60 wt %, and a non-saponifiables concentration of about 5 wt % to about 40 wt %. Crude tall oil can include at least 5 wt %, at least 8 wt %, or at least 10 wt % neutral and non-saponifiable components. Fatty acid triglycerides can be present in an amount of less than 10 wt %, less than 5 wt %, or less than 1 wt %, based on the total weight of the collector.

Use of a tall oil material (also referred to as a TOFA containing composition) can be a preferred starting material based on considerations of cost, availability, and/or performance. Tall oil refers to the resinous yellow-black oily liquid obtained as an acidified byproduct in the Kraft or sulfate processing of pine wood. Tall oil, prior to refining, is normally a mixture of rosin acids, fatty acids, sterols, high-molecular weight alcohols, and other alkyl chain materials. Distillation of crude tall oil is often used to recover a mixture of fatty acids in the $C_{16}$-$C_{24}$ range. Commercially available tall oil products such as XTOL® 100, XTOL® 300, and XTOL® 304 (all from Georgia-Pacific Chemicals LLC, Atlanta, Ga.), for example, all contain saturated and unsaturated fatty acids in the $C_{16}$-$C_{24}$ range, as well as minor amounts of rosin acids. It is understood by those skilled in the art that tall oil is derived from natural sources and thus its composition varies among the various sources.

The carboxylic acid derivative reactant of formula II can also be or include one or more triglycerides. Most plant and animal oils are mixtures of triglycerides and fatty acids. Triglycerides are generally made from fatty acids with typically 10 to 24 carbon atoms and from 0 to 3 double bonds in their chains. Some triglycerides are made from hydroxyl fatty acids that have an alcohol group somewhere in the chain, e.g., castor oil. Vegetable oils such as canola and corn oil can be used as feedstocks for the carboxylic acids. Through the use of known saponification techniques, a number of vegetable oils (triglycerides), such as linseed (flaxseed) oil, castor oil, tung oil, soybean oil, cottonseed oil, olive oil, canola oil, corn oil, sunflower seed oil, peanut oil, coconut oil, safflower oil, palm oil and mixtures thereof, to name just a few, can be used as a source of the fatty acid(s) for making a collector composition. One preferred source of fatty acids is tall oil. One particular source of such preferred fatty acid is distilled tall oil containing no more than about 6 wt % rosin acid and other constituents and referred to as TOFA.

The polyamine can have the formula:

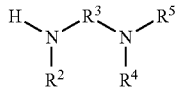

(Formula III)

where $R^2$, $R^3$, $R^4$, and $R^5$ can be as discussed and described above with respect to Formula I. The amino groups can be primary, secondary, and/or tertiary amines Illustrative polyamines can include, but are not limited to, diethylenetriamine ("DETA"), 1,3-diaminopentane ("DAMP"), N-(hydroxyethyl)ethylenediamine, 3-(dimethylamino)-1-propylamine, aminoguanidine bicarbonate, 1,5-diamino-2-methylpentane, lysine.HCl, diaminoisophorone, 1,2-diaminopropane, 2,4-diaminotoluene, 2,4-diaminobenzene sulfonic acid, N,N-dimethylaminopropyl-N-proplyenediamine, 3-(N,N-diethylamino)propylamine, 2-amino-4-methylpyridine, 2-(N,N-diethylamino)ethylamine, 2-amino-6-methylpyridine, 2-aminothiazole, aminoguanidine carbonate, aminoethylpiperazine, 1-methylpiperazine, L-arginine, 2-aminopyrimidine, aminoethylaminopropyltrimethoxysilane, 2-aminopyridine, 5-aminotetrazole, 2-amino-3-methylpyridine, 2-aminobenzothiazole, 3-aminomethylpyridine, 3-picolylamine) (pyridine, 3-aminomethyl), 3-morpholinopropylamine, 1-ethylpiperazine, N-methylpropylenediamine, histidine, L-monohydrochloride monohydrate, aminoethylaminoethylaminopropyltrimethoxysilane, 3-aminopyridine, N-ethylethylenediamine, aminopropylimidazole, 2-methylpiperazine, 2-amino-5-diethylaminopentane, 3-amino-1,2,4-triazole, aminoguanidine hydrochloride, 2-(N,N-dimethylamino)ethylamine, L-ornithine-monohydrochloride, L-Histidine-free base 99%, N-(aminoethyl)morpholine, L-tryptophan, adenine phosphate, 6-aminopurine (adenine), agmatine sulfate, tryptamine [2-(1H-indol-3-yl)ethanamine], histamine, 1-[2-[[2-[(2-aminoethyl)amino]ethyl]amino]ethyl]-piperazine), N-[(2-aminoethyl)-2-aminoethyl]piperazine)], 5,6-diamino-2-thiouracil, adenosine, adenosine 3',5'-cyclic monophosphate, adenosine 3',5'-cyclic monophosphate, S-adenosylmethionine, S-adenosyl homocysteine, 5-hydroxylysine, L(+)-ornithine-ketoglutarate, L-ornithine ethyl ester DiHCl, L-ornithine ethyl ester HCl, L-ornithine, L-aspartate, carnosine [beta-alanyl-L-histidine], serotonin [5-hydroxytryptamine], 5-hydroxytryptophan, N-methyltryptamine, norbaeocystin [4-phosphoryloxy-tryptamine], 5,6-dibromotryptamine, 6-bromotryptamine, Mimosine [3-hydroxy-4-oxo-1-(4H)-pyridinealanine], anserine [beta-alanyl-N-methylhistidine], monatin, 3-hydroxykynurenine [2-amino-4-(2-amino-3-hydroxyphenyl)-4-oxobutanoic acid], kynurenine [2-Amino-4-(2-aminophenyl)-4-oxobutanoic acid], beta-methylamino-L-alanine, diphthamide [2-amino-3-[2-(3-carb amoyl-3-trimethylammoni o-propyl)-3H-imidazol-4-yl]propanoate], ibotenic acid [(S)-2-amino-2-(3-hydroxyisoxazol-5-yl) acetic acid], saccharopine [2-[(5-amino-5-carboxy-pentyl) amino] pentanedioic acid], hypusine [(R)—N-6-(4-amino-2-hydroxybutyl)-L-lysine], S-aminoethyl-L-cysteine [(R)-2-amino-3-(2-amino-ethylsulfanyl)-propionic acid], 4-aminopiperidine, 3-aminopiperidine, 2,4-diaminobenzoic acid, 1,2-diaminoanthraquinone, 2,3-diaminophenol, 2,4-diaminophenol, 2,3-diaminopropionic acid, 1-amino-4-methylpiperidine, 4-(aminomethyl)piperidine, 4-amino-2,2,6,6-tetramethylpiperidine, 3-aminopyrrolidine, 4-aminobenzylamine, 2-aminobenzylamine, or any mixture thereof.

Standard coupling reagents can be applied to activate the carboxylic acid prior to the condensation reaction. The carboxylic acid and/or carboxylic acid derivative can be mixed with a coupling reagent such as 1-ethyl-3-(3-dimethylaminopropyl) carbodiimide) ("EDC") or (EDC.HCl), N,N'-Dicyclohexylcarbodiimide ("DCC"), O-Benzotriazole-N,N,N',N'-tetramethyl-uronium-hexafluoro-phosphate ("HBTU"), O-(Benzotriazol-1-yl)-N,N,N',N'-tetramethyluronium tetrafluoroborate ("TBTU"), or any mixture thereof in an inert solvent such as N,N-dimethylformamide, dimethylacetamide ("DMA") or dichloromethane ("DCM") together with the desired polyamine. Optionally a base (e.g., N,N-diisopropylethyl amine, triethylamine, N-methyl morpholine, and/or 1-hydroxybenzotriazole ("HOBT")) can be added. The reaction mixture can be stirred for about 1 hour to about 24 hours, for example, at a temperature of about −30° C. to about 70° C.

The etheramine can be an ether monoamine of the formula:

$$R^6—O—R^7NH_2 \quad \text{(Formula IV)}$$

where $R^6$ can be selected from hydrogen, $(C_1-C_{18})$alkyls, halogen-$(C_1-C_{18})$alkyls, phenyl, $(C_1-C_6)$alkenyls, heterocyclyls, unsubstituted aryls, and aryls substituted by one or more substituents selected from halogens, $(C_1-C_{18})$alkyls, and halogen-$(C_1-C_{18})$alkyls; and $R^7$ can be selected from hydrogen, $(C_1-C_6)$alkyls, halogen-$(C_1-C_6)$alkyls, phenyl, $(C_1-C_6)$alkenyls, heterocyclyls, unsubstituted aryls, and aryls substituted by one or more substituents selected from halogens, $(C_1-C_6)$alkyls, and halogen-$(C_1-C_6)$alkyls. Illustrative ether monoamines can include, but are not limited to, isohexyloxypropyl amine, 2-ethylhexyloxypropyl amine, octyloxypropyl amine, decyloxypropyl amine, isodecyloxypropyl amine, dodecyloxypropyl amine, tetradecyloxypropyl amine, isotridecyloxypropyl amine, tetradecyloxypropyl amine, dodecyloxypropyl amine, linear alkyloxypropyl amine, 3-(8-methylnonoxy)propan-1-amine, 3-(7-methylnonoxy)propan-1-amine, 3-(6-methylnonoxy)propan-1-amine, 3-(5-methylnonoxy)propan-1-amine, 3-(4-methylnonoxy)propan-1-amine, 3-(3-methylnonoxy)propan-1-amine, 3-(2-methylnonoxy)propan-1-amine, 3-(8-methylnoctyloxy)propan-1-amine, 3-(7-methylnoctyloxy)propan-1-amine, 3-(6-methylnoctyloxy)propan-1-amine, 3-(5-methylnoctyloxy)propan-1-amine, 3-(4-methylnoctyloxy)propan-1-amine, 3-(3-methylnoctyloxy)propan-1-amine, 3-(2-methylnoctyloxy)propan-1-amine, 2-(8-methylnonoxy)ethan-1-amine, 2-(7-methylnonoxy)ethan-1-amine, 2-(6-methylnonoxy)ethan-1-amine, 2-(5-methylnonoxy)ethan-1-amine, 2-(4-methylnonoxy)ethan-1-amine, 2-(3-methylnonoxy)ethan-1-amine, 2-(2-methylnonoxy)ethan-1-amine, 3-(8-ethylnonoxy)propan-1-amine, 3-(7-ethylnonoxy)propan-1-amine, 3-(6-ethylnonoxy)propan-1-amine, 3-(5-ethylnonoxy)propan-1-amine, 3-(4-ethylnonoxy)propan-1-amine, 3-(3-ethylnonoxy)propan-1-amine, 3-(2-ethylnonoxy)propan-1-amine, 3-(8-ethylnoctyloxy)propan-1-amine, 3-(7-ethylnoctyloxy)propan-1-amine, 3-(6-ethylnoctyloxy)propan-1-amine, 3-(5-ethylnoctyloxy)propan-1-amine, 3-(4-ethylnoctyloxy)propan-1-amine, 3-(3-ethylnoctyloxy)propan-1-amine, 3-(2-ethylnoctyloxy)propan-1-amine, 2-(8-ethylnonoxy)ethan-1-amine, 2-(7-ethylnonoxy)ethan-1-amine, 2-(6-ethylnonoxy)ethan-1-amine, 2-(5-ethylnonoxy)ethan-1-amine, 2-(4-ethylnonoxy)ethan-1-amine, 2-(3-ethylnonoxy)ethan-1-amine, 2-(2-ethylnonoxy)ethan-1-amine, 3-(8-propylnonoxy)propan-1-amine, 3-(7-propylnonoxy)propan-1-amine, 3-(6-propylnonoxy)propan-1-amine, 3-(5-propylnonoxy)propan-1-amine, 3-(4-propylnonoxy)propan-1-amine, 3-(3-propylnonoxy)propan-1-amine, 3-(2-propylnonoxy)propan-1-amine, 3-(8-propylnoctyloxy)propan-1-amine, 3-(7-propylnoctyloxy)propan-1-amine, 3-(6-propylnoctyloxy)propan-1-amine, 3-(5-propylnoctyloxy)propan-1-amine, 3-(4-propylnoctyloxy)propan-1-amine, 3-(3-propylnoctyloxy)propan-1-amine, 3-(2-propylnoctyloxy)propan-1-amine, 2-(8-propylnonoxy)ethan-1-amine, 2-(7-propylnonoxy)ethan-1-amine, 2-(6-propylnonoxy)ethan-1-amine, 2-(5-propylnonoxy)ethan-1-amine, 2-(4-propylnonoxy)ethan-1-amine, 2-(3-propylnonoxy)ethan-1-amine, 2-(2-propylnonoxy)ethan-1-amine, or any mixture thereof.

The etheramine can also be an ether diamine of the formula:

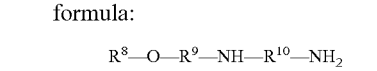

$$R^8—O—R^9—NH—R^{10}—NH_2 \quad \text{(Formula V)}$$

where $R^8$ can be selected from hydrogen, $(C_1-C_{18})$alkyls, halogen-$(C_1-C_{18})$alkyls, phenyl, $(C_1-C_{18})$alkenyls, heterocyclyls, unsubstituted aryls, and aryls substituted by one or more substituents selected from halogens, $(C_1-C_{18})$alkyls, and halogen-$(C_1-C_{18})$alkyls; $R^9$ and $R^{10}$ can be independently selected from hydrogen, $(C_1-C_6)$alkyls, halogen-$(C_1-C_6)$alkyls, phenyl, $(C_1-C_6)$alkenyls, heterocyclyls, unsubstituted aryls, and aryls substituted by one or more substituents selected from halogens, $(C_1-C_6)$alkyls, and halogen-$(C_1-C_6)$alkyls. Illustrative ether diamines can include, but are not limited to, octyloxypropyl-1,3-diaminopropane, decyloxypropyl-1,3-diaminopropane, isodecyloxypropyl-1,3-diaminopropane, dodecyloxypropyl-1,3-diaminopropane, tetradecyloxypropyl-1,3-diaminopropane, isotridecyloxypropyl-1,3-diaminopropane, or any mixture thereof.

The amidoamines of Formula I and the etheramines of Formula IV and/or Formula V can be combined with one another to form a collector in an amount of about 1 wt % to about 99 wt %, based on the combined weight of the amidoamine(s) and the etheramine(s) to provide or produce a collector composition. The collector composition can be used for silicate flotation. For example, the collector can include, but is not limited to, one or more alkyl ether amines, one or more alkyl ether diamines, one or more alkylamines, or one or more quaternary ammonium salts combined with a compound having Formula 1.

The collector composition can include, but is not limited to, about 1 wt % to about 99 wt % of the amidoamine of formula I and about 1 wt % to about 99 wt % of the etheramine of the Formula IV and/or Formula V. For example, the collector composition can include the amidoamine in an amount of about 1 wt %, about 5 wt %, about 10 wt %, about 15 wt %, about 20 wt %, about 25 wt %, about 30 wt %, about 35 wt %, about 40 wt %, about 45 wt %, about 50 wt %, about 55 wt %, about 60 wt %, about 65 wt %, about 70 wt %, about 75 wt %, about 80 wt %, about 85 wt %, about 90 wt %, about 95 wt %, or about 99 wt %, based on the total weight of the amidoamine(s) and the etheramine(s). In another example, the weight ratio of the amidoamine to the etheramine in the collector composition can be from about 99:1 to about 1:99, about 90:10 to about 10:90, about 80:20 to about 20:80, about 70:30 to about 30:70, about 65:35 to about 35:65, about 60:40 to about 40:60, about 55:45 to about 45:55, or about 50:50.

The collector can be mixed, blended, or otherwise contacted with a particulate or solids containing aqueous suspension or slurry to produce a treated mixture. The dosage or amount of the collector composition that can be added to an aqueous slurry of an ore can be from a low of about 1 g, about 10 g, about 20 g, or about 30 g to a high of about 50 g, about 60 g, about 70 g, about 90 g, about 120 g, about 150 g, about 175 g, or about 200 g per tonne of ore. In another example the amount of the collector composition can be about 60 g/tonne, about 80 g/tonne, about 90 g/tonne, about 100 g/tonne, about 110 g/tonne, about 120 g/tonne, about 125 g/tonne, about 130 g/tonne, about 140 g/tonne, about 150 g/tonne, about 175 g/tonne, or about 200 g/tonne.

A concentrate recovered from a froth flotation process that uses the collector composition can have a silica concentration of less than about 10 wt %, less than about 8 wt %, less than about 7 wt %, less than about 6 wt %, less than about 5 wt %, less than about 4 wt %, less than about 3 wt %, less than about 2 wt %, less than about 1 wt %, or less than about 0.5 wt %, based on the solids weight of the concentration. The concentrate recovered from the froth flotation process that uses the collector composition can have an iron concentration of about 85 wt % or more, about 87 wt % or more, about 88 wt % or more, about 89 wt % or more, about 90 wt % or more, about 91 wt % or more, about 92 wt % or more, about 93 wt % or more, about 94 wt % or more, or about 95 wt % or more. The iron in a reject portion recovered from a froth flotation process that uses the collector composition can be less than about 35 wt %, less than about 33 wt %, less than about 30 wt %, less than about 27 wt %, less than about 25 wt %, or less than about 23 wt %.

The collector composition can also be used in combination with one or more frothers or frothing agents and/or one or more depressants, as are known from the prior art. To avoid, in the case of silicate flotation from iron ore, this being co-discharged, preferably hydrophilic polysaccharides such as, for example, modified starch, carboxymethylcellulose or gum arabic, can be added as depressants in dosages of about 10 g/tonne to about 1,000 g/tonne.

Silicate flotation can be carried out at a pH of about 7 to about 12, e.g., about 8 to about 11. The pH of the aqueous mixture to be separated can be set or adjusted, for example, via addition of sodium hydroxide and/or potassium hydroxide.

The collector composition containing one or more amidoamines and one or more etheramines can be used in froth flotation processes for the beneficiation of a wide variety of value materials or particulates. Illustrative value materials can include, but are not limited to, minerals or metals such as phosphate, potash, lime, sulfate, gypsum, iron, platinum, gold, palladium, titanium, molybdenum, copper, uranium, chromium, tungsten, manganese, magnesium, lead, zinc, clay, coal, silver, graphite, nickel, bauxite, borax, borate, high molecular weight hydrocarbons such as bitumen, or any combination thereof. Often, the raw materials to be purified and recovered contain sand and/or clay. The collector compositions containing the one or more amidoamines and the one or more etheramines can be selective toward sand and/or clay.

Although clay is often considered an impurity in conventional metal or mineral ore beneficiation, it can also be present in relatively large quantities, and can be the desired or main component to be recovered. Some clays, for example kaolin clay, are valuable minerals that can be used in a number of applications, such as mineral fillers in the manufacture of paper and rubber. Thus, one froth flotation process in which the collector composition can be employed can include the separation of clay from a clay-containing ore. The impurities in such ores can be metals and their oxides, such as iron oxide and titanium dioxide, which are preferentially floated via froth flotation. Other impurities of clay-containing ores include coal. For example, impurities present in most Georgia kaolin include iron-bearing titania and various minerals such as mica, ilmenite, and/or tourmaline, which are generally also iron-containing. Thus, the clay, which selectively associates with the collector composition, is separately recoverable from metals, metal oxides, and coal.

The separation processes discussed and described herein are applicable to "suspensions" as well as to "slurries" of solid particles. These terms are sometimes defined equivalently and sometimes are distinguished based on the need for the input of at least some agitation or energy to maintain homogeneity in the case of a "slurry." As used herein, however, the terms "suspension" and "slurry" are used interchangeably with one another.

In the purification of clay, it is often advantageous to employ, in conjunction with the collector composition an anionic collector such as oleic acid, a flocculant such as polyacrylamide, a clay dispersant such as a fatty acid and/or a rosin acid, and/or oils to control frothing.

The collector composition can be used in froth flotation processes for the beneficiation of coal, phosphate or potash, as well as other value metals and minerals discussed above, in which the removal of siliceous gangue materials such as sand and/or clay and other impurities is an important factor in achieving favorable process economics. Potassium ores and other ores, for example, generally comprise a mixture of minerals in addition to sylvite (KCl), which is desirably recovered in the froth concentrate. Other ores include halite (NaCl), clay, and carbonate minerals which are non-soluble in water, such as aluminum silicates, calcite, dolomite, and anhydrite. Other ore impurities include iron oxides, titanium oxides, iron-bearing titania, mica, ilmenite, tourmaline, aluminum silicates, calcite, dolomite, anhydrite, ferromagnesian, feldspar, and debris or various other solid impurities such as igneous rock and soil. In the case of coal beneficiation, non-combustible solid materials such as calcium magnesium carbonate are considered impurities.

Coals to be beneficiated can include anthracite, lignite, bituminous, sub-bituminous, and the like. The coal can be pulverized and cleaned using any available technology. Ultimately, an aqueous slurry of coal particles having a concentration of solids which promotes rapid flotation can be prepared. Generally, a solids concentration of from about 2 wt % to about 25 wt % coal solids, more usually from about 5 wt % to about 15 wt %, is suitable.

The particle size of the coal in the flotation feed can be less than about 600 μm. For example, the coal particles in the flotation feed to be treated can have a particle size of less than about 600 μm, less than about 500 μm, less than abut 400 μm, less than about 300 μm, less than about 200 μm, less than about 100 μm, or less than about 50 μm.

The amount of the collector composition added to the aqueous coal slurry for obtaining the greatest recovery of combustible coal particles with an acceptable ash content can be dependent, at least in part, on a variety of diverse factors such as particle size, coal rank, degree of surface oxidation, the initial ash content of the coal feed, and the amount of any frothing agents and/or other adjuvants added to the aqueous coal slurry. A suitable loading of the collector mixture can be determined by routine experiments. When the collector composition is employed with only a frothing agent, the collector composition can be present in an amount from about 0.001 wt % to about 0.4 wt %, or from about 0.005 wt % to about 0.1 wt %, based on the weight of coal solids in the aqueous coal slurry.

The collector composition can be used in combination with one or more frothing agents. A frothing agent can be used to promote the formation of a suitably structured froth. Illustrative frothing agents can include, but are not limited to, pine oils, cresol, 2-ethyl hexanols, aliphatic alcohols such as isomers of amyl alcohol and other branched $C_4$ to $C_8$ alkanols, polypropylene glycols, ethers, methyl cyclohexyl methanols, or any combination thereof. Particularly suitable frothing agents can include, but are not limited to, methyl isobutyl carbinol (MIBC), polypropylene glycol alkyl, and/or phenyl ethers. The amount of frothing agent added to aqueous coal slurry can be influenced by a number of factors, which can include, but are not limited to, particle size, rank of the coal, and degree of oxidation of the coal. The amount of the frothing agent added to the aqueous slurry of coal can range from about 0.001 wt % to about 0.1 wt % or about 0.01 wt % to about 0.05 wt %, based on the weight of coal solids in the aqueous coal slurry.

The collector composition can be used for the separation of coal in combination with one or more other adjuvants or additives. For example, activators, conditioners, dispersants, depressants, pour point depressants, and/or freeze point depressants.

The addition of a pour point depressant or a freezing point depressant to the collector composition can be useful in cold climates for maintaining the fluidity of the collector composition. Suitable pour point depressants or freeze point depressants can include, but are not limited to, fatty acids esters, particularly when esterified with a low molecular weight alcohol like ethanol or methanol, poly alkyl acrylates, poly alkyl methacrylates, copolymers of styrene and dialkyl maleates, copolymers of styrene and dialkyl fumarates, copolymers of styrene and alkyl acrylates, copolymers of styrene and alkyl methacrylates, alkylphenoxy poly(ethylene oxide)ethanol, alkylphenoxy poly(propylene oxide) propane diol, propylene glycol, ethylene glycol, diethylene glycol, acetate salts, acetate esters, chloride salts, formate esters, formate salts, glycerin, diesters of diacids, copolymers of dialkyl fumarates and vinyl acetate, copolymers of dialkyl maleate and vinyl acetate, copolymers of alkyl acrylate and vinyl acetate, copolymers of alkyl methacrylate and vinyl acetate, an combination thereof, or any mixture thereof. The pour point depressant can be present in an amount from a low of about 1 wt %, about 3 wt %, about 5 wt % or about 10 wt % to a high of about 30 wt %, about 40 wt %, about 50 wt %, or about 60 wt %, based on the weight of the collector composition.

The coal can be floated at the natural pH of the aqueous coal slurry, which usually can vary from about 3 to about 9.5 depending upon the composition of the feed. However, the pH can optionally be adjusted to maintain the pH of the aqueous coal slurry prior to and during flotation at a value of about 4 to about 9, more usually from about 5.5 to about 9. If the coal is acidic in character, the pH can be adjusted using an alkaline material, such as soda ash, lime, ammonia, potassium hydroxide or magnesium hydroxide, and/or sodium hydroxide. If the aqueous coal slurry is alkaline in character, a carboxylic acid, such acetic acid, and/or a mineral acid, such as sulfuric acid and/or hydrochloric acid, can be used to adjust the pH, if desired.

The collector-treated and pH-adjusted aqueous coal slurry can be aerated in a conventional flotation machine or bank of rougher cells to float the coal. Any conventional flotation unit can be employed.

The collector composition can be used to separate a wide variety of contaminants from a liquid, e.g., water. For example, the collector composition can be used to separate siliceous contaminants such as sand, clay, and/or ash from aqueous liquid suspensions or slurries containing one or more of these siliceous contaminants. Aqueous suspensions or slurries can therefore be treated with the collector composition allowing for the effective separation of at least a portion of the contaminants, in a contaminant-rich fraction, to provide a purified liquid. A "contaminant-rich" fraction refers to a part of the liquid suspension or slurry that is enriched in solid contaminants, i.e., contains a higher percentage of solid contaminants than originally present in the liquid suspension or slurry. Conversely, the purified liquid has a lower percentage of solid contaminants than originally present in the liquid suspension or slurry.

The treatment can involve adding an effective amount of the collector composition to electronically interact with and either coagulate or flocculate one or more solid contaminants into larger agglomerates. An effective amount can be readily determined depending on a number of variables (e.g., the type and concentration of contaminant), as is readily appreciated by those having skill in the art. In other embodiments, the treatment can involve contacting the liquid suspension continuously with a fixed bed of the collector composition, in solid form.

During or after the treatment of a liquid suspension with the collector composition, the coagulated or flocculated solid contaminant (which can now be, for example, in the form of larger, agglomerated particles or flocs) can be removed. Removal can be affected by flotation (with or without the use of rising air bubbles as described previously with respect to froth flotation), filtration, and/or sedimentation. The optimal approach for removal will depend on the relative density of the flocs and other factors. Increasing the quantity of collector composition amine that can be used to treat the suspension can in some cases increase the tendency of the flocs to float rather than settle. Filtration or straining can also be an effective means for removing the agglomerated flocs of solid particulates, regardless of whether they reside predominantly in a surface layer or in a sediment.

Examples of liquid suspensions that can be purified include oil and gas drilling fluids, which accumulate solid particles of rock (or drill cuttings) in the normal course of their use. These drilling fluids (often referred to as "drilling muds") are important in the drilling process for several reasons, including transporting these drill cuttings from the drilling area to the surface, where their removal allows the drilling mud to be recirculated. The addition of collector composition to oil well drilling fluids, and especially water-based (i.e., aqueous) drilling fluids, effectively coagulates or flocculates solid particle contaminants into larger clumps (or flocs), thereby facilitating their separation by settling or flotation. The collector composition can be used in conjunction with known flocculants such as polyacrylamides and/or hydrocolloidal polysaccharides. Generally, in the case of suspensions of water-based oil or gas drilling fluids, the separation of the solid contaminants can be sufficient to provide a purified drilling fluid for reuse in drilling operations.

Other kinds of aqueous suspensions can include the clay-containing aqueous suspensions or brines, which accompany ore refinement processes, including those described above. The production of purified phosphate from mined calcium phosphate rock, for example, generally relies on multiple separations of solid particulates from aqueous media, whereby such separations can be improved using the collector composition. In the overall process, calcium phosphate can be mined from deposits and the phosphate rock can be initially recovered in a matrix containing sand and clay impurities. The matrix can be mixed with water to form a slurry, whichafter mechanical agitation, can be screened to retain phosphate pebbles and to allow fine clay particles to pass through as a clay slurry effluent with large amounts of water.

These clay-containing effluents can have high flow rates and typically carry less than about 10 wt % solids and more often contain only from about 1 wt % to about 5 wt % solids. The dewatering (e.g., by settling or filtration) of this waste clay, which allows for recycle of the water, poses a significant challenge for reclamation. The time required to dewater the clay, however, can be decreased through treatment of the clay slurry effluent, obtained in the production of phosphate, with the collector composition. Reduction in the clay settling time allows for efficient re-use of the purified water, obtained from clay dewatering, in the phosphate production operation. In one embodiment of the purification method, where the liquid suspension is a clay-containing effluent slurry from a phosphate production facility, the purified liquid can contain less than about 1 wt % solids after a settling or dewatering time of less than about 1 month.

In addition to the phosphate pebbles that can be retained by screening and the clay slurry effluent described above, a mixture of sand and finer particles of phosphate can also obtained in the initial processing of the mined phosphate matrix. The sand and phosphate in this stream can be separated by froth flotation which, as described above, can be improved using the collector composition as a depressant for the sand.

In the area of slurry dewatering, another specific application of the collector composition can be in the filtration of coal from water-containing slurries. The dewatering of coal is important commercially, since the BTU value per unit weight and hence the quality of the coal decreases with increasing water content. In one embodiment, therefore, the collector composition can be used to treat an aqueous coal-containing suspension or slurry prior to dewatering the coal by filtration.

As used herein, the term "beneficiation" broadly refers to any process for purifying and/or upgrading a value material as described herein. In the case of coal ore purification, a number of beneficiation operations are conventionally used in an effort to improve the quality of coal that is burned, for example, in electricity-generating power plants. As discussed previously, for example, such quality improvement processes address environmental concerns that have resulted in lower tolerances for metallic contaminants such as mercury and arsenic, as well as nitrogen- and sulfur-containing compounds. Froth flotation, as discussed above, can be one method for the purification of a coal ore via treatment of an aqueous slurry of the ore with the collector composition. Treatment can alternatively occur prior to or during conventional coal size or density classification operations to facilitate the reduction in the amount(s) of one or more of the mercury, nitrogen, sulfur, silicon, ash, and pyrite impurities in the purified coal, wherein these impurities are measured on a volatile free weight basis and as described previously. The collector composition can also be used in conjunction with size or density classification operations to reduce moisture and/or increase the fuel value of the purified coal (e.g., measured in BTU/lb). Preferably, the reduction of the amount(s) of one or more (e.g., two or more, or all) of the impurities described above, in the purified coal recovered in the size or density classification operation is/are preferably less than the corresponding reference amount(s) in a purified reference coal recovered in the same size or density classification operation, but without using the collector composition.

In general, the reduction of one of the impurities noted above in the purified coal, results in a corresponding reduction in the amount of one or more other undesired impurities. For example, a reduction in pyrite generally leads to a reduction in mercury and other inorganic materials such as silicon-containing ash. In one embodiment, the use of one or more size or density classification operations in conjunction with the collector composition results in a reduction in amounts of all the impurities noted above.

Suitable conventional size or density classification operations include cyclone separation, heavy medium (or heavy media or dense medium) separation, filtration, and/or screening, any of which can be used in combination (e.g., serially and/or in parallel) with each other or with froth flotation. Generally, these operations precede froth flotation to provide, in combination with froth flotation, an upgraded or purified coal meeting the various specifications (e.g., nitrogen and sulfur levels) required for combustion in electricity-generating power plants. For example, water-only or clarifying cyclone operations process a feed stream of a raw coal ore slurry, which can be fed tangentially under pressure into a cyclone. Centrifugal force can move heavier material to the cyclone wall, where it is subsequently typically transported to the underflow at the apex (or spigot). Lighter coal particles that are disposed toward the center of the cyclone can be removed via a pipe (or vortex finder) to the overflow. The targeted density at which light and heavy particles are separated can be adjusted by varying pressure, vortex finder length, and/or apex diameter. Such water-only or clarifying cyclones typically treat material in the size range of about 0.5 mm to about 1 mm and can involve two ore more stages of separation to improve separation efficiency.

Heavy medium separation can use a dense liquid medium (e.g., magnetite at a specified magnetite/water ratio) to float particles (e.g., coal) having a density below that of the medium and depress particles (e.g., sand or rock) having a density above that of the medium. Heavy medium separation can be employed in a simple deep or shallow "bath" configuration or can be included as part of a cyclone separation operation to enhance the gravitational separation forces with centrifugal forces. Often, one or more stages of a clarifying cyclone separation operation are followed by one or more stages of heavy medium cyclone separation and one ore more screening steps to yield an appropriately sized and purified (e.g., a pre-conditioned or pre-treated) coal feedstock for subsequent froth flotation.

Another application of the collector composition can be in the area of sewage treatment, accompanied by various processes that are undertaken to remove contaminants from industrial and municipal waste water. Such processes can purify sewage to provide both purified water that is suitable for disposal into the environment (e.g., rivers, streams, and oceans) as well as a "sludge." Sewage refers to any type of water-containing wastes which are normally collected in sewer systems and conveyed to treatment facilities. Sewage therefore includes municipal wastes from toilets (sometimes referred to as "foul waste") and basins, baths, showers, and kitchens (sometimes referred to as "sullage water"). Sewage can also include industrial and commercial waste water, (sometimes referred to as "trade waste"), as well as stormwater runoff from hard-standing areas such as roofs and streets.

Conventional processes for purifying sewage often involve preliminary, primary, and/or secondary steps. Preliminary steps often include the filtration or screening of large solids such as wood, paper, rags, etc., as well as coarse sand and grit, which would normally damage pumps. Subsequent primary steps are then employed to separate most of the remaining solids by settling in large tanks, where a solids-rich sludge is recovered from the bottom of these tanks and processed further. A purified water is also recovered and normally subjected to secondary steps involving biological processes.

Thus, in one embodiment, the purification of sewage water by settling or sedimentation can comprise treating the sewage water, before or during the settling or sedimentation operation, with the collector composition. This treatment can be used to improve settling operation (either batch or continuous), for example, by decreasing the residence time required to effect a given separation (e.g., based on the purity of the purified water and/or the percent recovery of solids in the sludge). Otherwise, the improvement can be manifested in the generation of a higher purity of the purified water and/or a higher recovery of solids in the sludge, for a given settling time.

After treatment of sewage with the collector composition and removing a purified water stream by sedimentation, it is also possible for the collector composition to be subsequently used for or introduced into one or more secondary steps as described above to further purify the water. These secondary operations normally rely on the action of naturally occurring microorganisms to break down organic material. In particular, aerobic biological processes substantially degrade the biological content of the purified water recovered from primary steps. The microorganisms (e.g., bacteria and protozoa) consume biodegradable soluble organic contaminants (e.g., sugars, fats, and other organic molecules) and bind much of the less soluble fractions into flocs, thereby further facilitating the removal of organic material.

Secondary processes can rely on "feeding" the aerobic microorganisms oxygen and other nutrients which allow them to survive and consume organic contaminants. Advantageously, the collector composition, which contains nitrogen, can serve as a "food" source for microorganisms involved in such secondary processing steps, as well as potentially an additional flocculant for organic materials. As such, the sewage purification method can also include, after removing purified water (in the primary treatment step) by sedimentation, further processing the purified water in the presence of microorganisms and the collector composition, and optionally with an additional amount of the collector composition, to reduce the biochemical oxygen demand (BOD) of the purified water. As is understood in the art, the BOD is an important measure of water quality and represents the oxygen needed, in mg/l (or ppm by weight) by microorganisms to oxidize organic impurities over 5 days. The BOD of the purified water after treatment with microorganisms and the collector composition, can be less than about 10 ppm, less than about 5 ppm, or less than about 1 ppm.

The collector composition can also be applied to the purification of pulp and paper mill effluents. These aqueous waste streams normally contain solid contaminants in the form of cellulosic materials (e.g., waste paper; bark or other wood elements, such as wood flakes, wood strands, wood fibers, or wood particles; or plant fibers such as wheat straw fibers, rice fibers, switchgrass fibers, soybean stalk fibers, bagasse fibers, or cornstalk fibers; and mixtures of these contaminants). The effluent stream containing one or more cellulosic solid contaminants can be treated with the collector composition and purified water can be removed via sedimentation, flotation, and/or filtration.

In the separation of bitumen from sand and/or clay impurities as described previously, various separation steps can be employed either before or after froth flotation of the bitumen-containing slurry. These steps can include screening, filtration, and/or sedimentation, any of which can benefit from treatment of the oil sand slurry with the collector composition, followed by removal of a portion of the sand and/or clay contaminants in a contaminant-rich fraction (e.g., a bottoms fraction) or by removal of a purified bitumen fraction. As described above with respect to phosphate ore processing, water effluents, which generally contain solid clay particles, can be subjected to a treating step that can include flocculating the contaminants to facilitate their removal (e.g., by filtration). Waste water effluents from bitumen processing facilities can also contain sand and/or clay impurities and therefore can benefit from treatment with the collector composition to dewater the waste water effluents and/or remove at least a portion of the solid impurities in a contaminant-rich fraction. A particular process stream of interest that can be generated during bitumen extraction is known as the "mature fine tails," which is an aqueous suspension of fine solid particulates that can benefit from dewatering. Generally, in the case of sand and/or clay containing suspensions from a bitumen production facility, separation of the solid contaminants can be sufficient to allow the recovery or removal of a purified liquid or water stream that can be recycled to the bitumen process.

The treatment of various intermediate streams and effluents in bitumen production processes with the collector composition is not limited only to those process streams that are at least partly subjected to froth flotation. As is readily appreciated by those of skill in the art, other techniques (e.g., centrifugation via the "Syncrude Process") for bitumen purification will generate aqueous intermediate and byproduct streams from which solid contaminant removal is desirable.

The collector composition can be employed in the removal of suspended solid particulates, such as sand and clay, in the purification of water, and particularly for the purpose of rendering it potable. Moreover, the collector composition can have the additional ability to complex metallic cations (e.g., lead and mercury cations) allowing these unwanted contaminants to be removed in conjunction with solid particulates. Therefore, the collector composition can be used to effectively treat impure water having both solid particulate contaminants as well as metallic cation contaminants. Without being bound by theory, it is believed that electronegative moieties, such as the carbonyl oxygen atom on the collector composition, complex with undesired cations to facilitate their removal. Generally, this complexation occurs at a pH of the water that is greater than about 5 and typically in the range from about 7 to about 9.

Another possible mechanism for the removal of metallic cations can be based on the cation's association with negatively charged solid particulates. Flocculation and removal of these particulates will therefore also cause, at least to some extent, the removal of metallic cations. Regardless of the mechanism, in one embodiment, the treatment and removal of both of these contaminants can be carried out to yield potable water.

EXAMPLES

In order to provide a better understanding of the foregoing discussion, the following non-limiting examples are offered. Although the examples can be directed to specific embodiments, they are not to be viewed as limiting the invention in any specific respect.

Collector compositions were tested in a Hallimond tube with a dosage of 5 ppm for each collector on quartz flotation ($SiO_2$, 99% pure). The tests were conducted at pH 10.5. Comparative example 1 (C1) was an etheramine, commercially available as Clairant® EDA-B. Comparative example 2 (C2) was a TOFA-DETA amidoamine. Example 1 (Ex. 1) was a collector composition composed of Clairant® EDA-B and a TOFA-DETA amidoamine in a weight ratio of 65:35. Whereas the TOFA-DETA amidoamine (C2) in laboratory testing required a dosage four times greater than the etheramine to achieve the required level of iron purity (grade), mixing the etheramine with the TOFA-DETA amidoamine (Ex. 1) in a 65:35 ratio achieves the required grade while delivering a higher recovery of iron (91.7% versus 87.6%). These surprising and unexpected results are summarized in the table below:

| Sample | Dose (g/ton) | Iron in Concentrate (%) | Silica in Concentrate (%) | Iron in Reject (%) | Silica in Reject (%) | Mass Recovery (%) | Iron Recovery (%) |
|---|---|---|---|---|---|---|---|
| C1 (Clariant EDA-B, Ether Amine) | 70 | 69.8 | 0.5 | 30.0 | 46.8 | 78.6 | 91.5 |
| C2A (TOFA-DETA amidoamine) | 70 | 57.7 | 11.8 | 57.6 | 11.8 | 91.1 | 87.7 |
| C2B (TOFA-DETA amidoamine) | 125 | 67.4 | 2.7 | 34.8 | 40.7 | 79.1 | 89.0 |
| Ex. 1 (Blend of C1 and C2 at a ratio of 65:35) | 70 | 69.5 | 0.6 | 30.4 | 46.8 | 79.1 | 91.7 |

The efficacy of this approach is not limited to TOFA-DETA amidoamines. Amidoamines made from TOFA and 1,3-diaminopentane, showed similar results. A TOFA-DAMP amidoamine (Ex.2) also was shown in comparison with the etheramine (C1), and the iron recovery in this case was 92.4%. Additional details of the are shown in the table below:

| Sample | Dose (g/ton) | Iron in concentrate (%) | Silica in concentrate (%) | Iron in Reject (%) | Silica in Reject (%) | Mass Recovery (%) | Iron Recovery (%) |
|---|---|---|---|---|---|---|---|
| C1 (Clariant EDA-B, Ether Amine) | 70 | 69.8 | 0.5 | 30.0 | 46.8 | 78.6 | 91.5 |

-continued

| Sample | Dose (g/ton) | Iron in concentrate (%) | Silica in concentrate (%) | Iron in Reject (%) | Silica in Reject (%) | Mass Recovery (%) | Iron Recovery (%) |
|---|---|---|---|---|---|---|---|
| C3A (TOFA-DAMP amidoamine) | 70 | 61.2 | 10.1 | 47.3 | 20.1 | 92.7 | 99.0 |
| C3B (TOFA-DAMP amidoamine) | 125 | 68.0 | 2.1 | 33.3 | 41.8 | 80.1 | 90.9 |
| Ex. 2 (Blend of C1 and C3 at a ratio of 65:35) | 70 | 69.8 | 0.6 | 29.4 | 47.6 | 79.4 | 92.4 |

Surprisingly and unexpectedly, when the TOFA-DAMP amidoamine was used in combination with the etheramine, the required purity and the same recovery with respect to C2 or even better recovery with respect to C3, even though a smaller quantity of the etheramine and a smaller quantity TOFA-DAMP amidoamine were used. The advantage of using the mixed collector composition can be an improved recovery or a decrease in cost as the amidoamine is sold at a lower price than the etheramine.

Embodiments of the present disclosure further relate to any one or more of the following paragraphs:

1. A method for enriching iron from iron-containing ores by froth flotation, wherein use is made, of a collector composition comprising: one or more amidoamines of the formula:

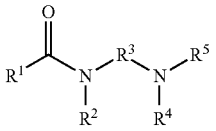

wherein where $R^1$ is selected from $(C_1\text{-}C_{24})$alkyls, $(C_1\text{-}C_{24})$alkenyls, $(C_1\text{-}C_{24})$dialkenyls; $R^2$ and $R^3$ are independently selected from hydrogen, $(C_1\text{-}C_6)$alkyls, halogen-$(C_1\text{-}C_6)$alkyls, phenyl, $(C_1\text{-}C_6)$alkenyls, heterocyclyls, unsubstituted aryls or aryls substituted by one or more substituents selected from halogens, $(C_1\text{-}C_6)$alkyls, and halogen-$(C_1\text{-}C_6)$alkyls; $R^4$ and $R^5$ are independently selected from hydrogen, $(C_1\text{-}C_6)$alkyls or $(C_1\text{-}C_6)$alkyls substituted by one or more substituents, and one or more etheramines of the formula:

$$R^6\text{—}O\text{—}R^7\text{—}NH_2$$

wherein $R^6$ is selected from hydrogen, $(C_1\text{-}C_{18})$alkyls, halogen-$(C_1\text{-}C_{18})$alkyls, phenyl, $(C_1\text{-}C_6)$alkenyls, heterocyclyls, unsubstituted aryls or aryls substituted by one or more substituents selected from halogens, $(C_1\text{-}C_{18})$alkyls, and halogen-$(C_1\text{-}C_{18})$alkyls; and $R^7$ is selected from hydrogen, $(C_1\text{-}C_6)$alkyls, halogen-$(C_1\text{-}C_6)$alkyls, phenyl, $(C_1\text{-}C_6)$alkenyls, heterocyclyls, unsubstituted aryls or aryls substituted by one or more substituents selected from halogens, $(C_1\text{-}C_6)$alkyls, and halogen-$(C_1\text{-}C_6)$alkyls, wherein a ratio of the amidoamine to the etheramine is from about 99:1 to about 1:99.

2. A method for enriching iron from iron-containing ores by froth flotation, wherein use is made, of a collector composition comprising: one or more amidoamines of the formula:

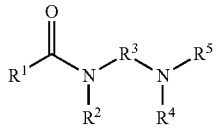

wherein where $R^1$ is selected from $(C_1\text{-}C_{24})$alkyls, $(C_1\text{-}C_{24})$alkenyls, $(C_1\text{-}C_{24})$dialkenyls; $R^2$ and $R^3$ are independently selected from hydrogen, $(C_1\text{-}C_6)$alkyls, halogen-$(C_1\text{-}C_6)$alkyls, phenyl, $(C_1\text{-}C_6)$alkenyls, heterocyclyls, unsubstituted aryls or aryls substituted by one or more substituents selected from halogens, $(C_1\text{-}C_6)$alkyls, and halogen-$(C_1\text{-}C_6)$alkyls; $R^4$ and $R^5$ are independently selected from hydrogen, $(C_1\text{-}C_6)$alkyls or $(C_1\text{-}C_6)$alkyls substituted by one or more substituents, and one or more etheramines of the formula:

$$R^8\text{—}R^9\text{—}NH\text{—}R^{10}\text{—}NH_2$$

wherein $R^8$ is selected from hydrogen, $(C_1\text{-}C_{18})$alkyls, halogen-$(C_1\text{-}C_{18})$alkyls, phenyl, $(C_1\text{-}C_{18})$alkenyls, heterocyclyls, unsubstituted aryls or aryls substituted by one or more substituents selected from halogens, $(C_1\text{-}C_{18})$alkyls, and halogen-$(C_1\text{-}C_{18})$alkyls; $R^9$ and $R^{10}$ are independently selected from hydrogen, $(C_1\text{-}C_6)$alkyls, halogen-$(C_1\text{-}C_6)$alkyls, phenyl, $(C_1\text{-}C_6)$alkenyls, heterocyclyls, unsubstituted aryls or aryls substituted by one or more substituents selected from halogens, $(C_1\text{-}C_6)$alkyls, and halogen-$(C_1\text{-}C_6)$alkyls, wherein a ratio of the amidoamine to the etheramine is from about 99:1 to about 1:99.

3. The method according to either of paragraph 1 or 2, wherein the amidoamine is made by reacting tall oil fatty acids and one or more polyamines.

4. The method according to any one of paragraph 1 to 3, wherein the amidoamine is made by reacting one or more carboxylic acids and one or more polyamines.

5. The method according to any one of paragraph 1 to 4, wherein the polyamine is diethylenetriamine.

6. The method according to any one of paragraph 1 to 5, wherein the polyamine is 1,3-diaminopentane.

7. A froth flotation method for removing solid contaminants from an aqueous slurry, comprising: contacting an aqueous slurry comprising one or more contaminants with a collector composition, wherein the collector composition comprises: one or more amidoamines of the formula:

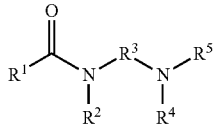

wherein where $R^1$ is selected from $(C_1-C_{24})$alkyls, $(C_1-C_{24})$alkenyls, $(C_1-C_{24})$dialkenyls; $R^2$ and $R^3$ are independently selected from hydrogen, $(C_1-C_6)$alkyls, halogen-$(C_1-C_6)$alkyls, phenyl, $(C_1-C_6)$alkenyls, heterocyclyls, unsubstituted aryls or aryls substituted by one or more substituents selected from halogens, $(C_1-C_6)$alkyls, and halogen-$(C_1-C_6)$alkyls; $R^4$ and $R^5$ are independently selected from hydrogen, $(C_1-C_6)$alkyls or $(C_1-C_6)$alkyls substituted by one or more substituents, and one or more etheramines of the formula:

$$R^6—O—R^7—NH_2$$

wherein $R^6$ is selected from hydrogen, $(C_1-C_{18})$alkyls, halogen-$(C_1-C_{18})$alkyls, phenyl, $(C_1-C_6)$alkenyls, heterocyclyls, unsubstituted aryls or aryls substituted by one or more substituents selected from halogens, $(C_1-C_{18})$alkyls, and halogen-$(C_1-C_{18})$alkyls; and $R^7$ is selected from hydrogen, $(C_1-C_6)$alkyls, halogen-$(C_1-C_6)$alkyls, phenyl, $(C_1-C_6)$alkenyl s, heterocyclyls, unsubstituted aryls or aryls substituted by one or more substituents selected from halogens, $(C_1-C_6)$alkyls, and halogen-$(C_1-C_6)$alkyls, and wherein a ratio of the amidoamine to the etheramine is from about 99:1 to about 1:99; recovering from the treated mixture a purified product having a reduced concentration of at least one contaminant relative to the aqueous slurry using froth flotation.

8. The method according to paragraph 7, wherein the ratio of the amidoamine to the etheramine is from about 35:65 to about 65:35.

9. The method according to paragraph 7, wherein the purified product comprises iron, one or more iron oxides, or a mixture thereof.

10. The method according to paragraph 7, wherein the purified produce comprises phosphorus, one or more phosphorus oxides, or a mixture thereof.

11. The method according to paragraph 7, wherein the at least one contaminant comprises silica.

12. A method for beneficiation of an ore, comprising: contacting a liquid suspension or slurry comprising one or more particulates with a collector to produce a treated mixture, wherein the collector comprises: one or more amidoamines having formula (I):

(I)

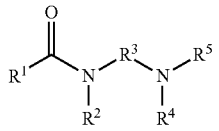

wherein $R^1$ is a $(C_1-C_{24})$alkyl, a $(C_1-C_{24})$alkenyl, or a $(C_1-C_{24})$dialkenyl; $R^2$ and $R^3$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls; $R^4$ and $R^5$ are independently selected from a hydrogen and a $(C_1-C_6)$alkyl, and one or more etheramines having formula (II):

$$R^6—O—R^7—NH_2 \quad (II)$$

wherein $R^6$ is a hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^7$ is a hydrogen, a $(C_1-C_6)$alkyl, a halogen-$(C_1-C_6)$alkyl, a phenyl, a $(C_1-C_6)$alkenyl, a heterocyclyl, an unsubstituted aryl, or an aryl substituted by one or more substituents selected from halogens, $(C_1-C_6)$alkyls, and halogen-$(C_1-C_6)$alkyls, or one or more etheramines having formula (III):

$$R^8—O—R^9—NH—R^{10}—NH_2 \quad (III)$$

wherein $R^8$ is a hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^9$ and $R^{10}$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls, wherein a weight ratio of the amidoamine to the etheramine is from about 99:1 to about 1:99; and recovering from the treated mixture a product comprising a purified liquid having a reduced concentration of the particulates relative to the treated mixture, a purified particulate product having a reduced concentration of liquid relative to the treated mixture, or both.

13. A method for beneficiation of an ore, comprising: contacting a liquid suspension or slurry comprising one or more particulates with a collector to produce a treated mixture, wherein the collector comprises: one or more amidoamines having formula (I):

(I)

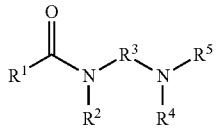

wherein $R^1$ is a $(C_1-C_{24})$alkyl, a $(C_1-C_{24})$alkenyl, or a $(C_1-C_{24})$dialkenyl; $R^2$ and $R^3$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls; $R^4$ and $R^5$ are independently selected from a hydrogen and a $(C_1-C_6)$alkyl, and one or more etheramines having formula (II):

$$R^6—O—R^7—NH_2 \quad (II)$$

wherein $R^6$ is a hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^7$ is a hydrogen, a $(C_1-C_6)$alkyl, a halogen-$(C_1-C_6)$alkyl, a phenyl, a $(C_1-C_6)$alkenyl, a heterocyclyl, an unsubstituted aryl, or an aryl substituted by one or more substituents selected from halogens, $(C_1-C_6)$alkyls, and halogen-$(C_1-C_6)$alkyls, or one or more etheramines having formula (III):

$$R^8—O—R^9—NH—R^{10}—NH_2 \quad (III)$$

wherein $R^8$ is a hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^9$ and $R^{10}$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls, wherein a weight ratio of the amidoamine to the etheramine is from about 99:1 to about 1:99; passing air through the treated mixture; and recovering from the treated mixture a product comprising a purified liquid having a reduced concentration of the particulates relative to the treated mixture, a purified particulate product having a reduced concentration of the liquid relative to the treated mixture, or both.

14. A method for beneficiation of an ore, comprising: contacting an aqueous suspension or slurry comprising one or more contaminants and one or more value materials with a collector composition to provide a treated mixture, wherein the collector composition comprises: one or more amidoamines having formula (I):

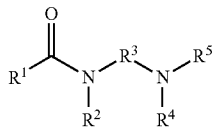

(I)

wherein $R^1$ is a $(C_1-C_{24})$alkyl, a $(C_1-C_{24})$alkenyl, or a $(C_1-C_{24})$dialkenyl; $R^2$ and $R^3$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls; $R^4$ and $R^5$ are independently selected from a hydrogen and a $(C_1-C_6)$alkyl, and one or more etheramines having formula (II):

$$R^6—O—R^7—NH_2 \quad (II)$$

wherein $R^6$ is a hydrogen, a $(C_1-C_{18})$alkyl, a halogen-$(C_1-C_{18})$alkyl, a phenyl, a $(C_1-C_6)$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^7$ is a hydrogen, a $(C_1-C_6)$alkyl, a halogen-$(C_1-C_6)$alkyl, a phenyl, a $(C_1-C_6)$alkenyl, a heterocyclyl, an unsubstituted aryl, or an aryl substituted by one or more substituents selected from halogens, $(C_1-C_6)$alkyls, and halogen-$(C_1-C_6)$alkyls, or one or more etheramines having formula (III):

$$R^8—O—R^9—NH—R^{10}—NH_2 \quad (III)$$

wherein $R^8$ is a hydrogen, a $(C_1-C_{18})$alkyl, a halogen-$(C_1-C_{18})$alkyl, a phenyl, a $(C_1-C_{18})$alkenyl, a heterocyclyl, an unsubstituted aryl, or an aryl substituted by one or more substituents selected from halogens, $(C_1-C_{18})$alkyls, and halogen-$(C_1-C_{18})$alkyls; and $R^9$ and $R^{10}$ are independently selected from a hydrogen, a $(C_1-C_6)$alkyl, a halogen-$(C_1-C_6)$alkyl, a phenyl, a $(C_1-C_6)$alkenyl, a heterocyclyl, an unsubstituted aryl, and an aryl substituted by one or more substituents selected from halogens, $(C_1-C_6)$alkyls, and halogen-$(C_1-C_6)$alkyls, wherein a weight ratio of the amidoamine to the etheramine is from about 99:1 to about 1:99; passing air through the treated mixture; and recovering from the treated mixture a product comprising the value material having a reduced concentration of the contaminant relative to the treated mixture.

15. The method according to any one of paragraphs 12 to 14, wherein the amidoamine is made by reacting tall oil fatty acids and one or more polyamines.

16. The method according to any one of paragraphs 12 to 14, wherein the amidoamine is made by reacting one or more carboxylic acids and one or more polyamines.

17. The method according to paragraph 15 or 16, wherein the polyamine is diethylenetriamine, 1,3-diaminopentane, or a mixture thereof.

18. The method according to any one of paragraphs 12 to 17, wherein the weight ratio of the amidoamine to the etheramine is from about 35:65 to about 65:35.

19. The method according to any one of paragraphs 12 to 18, wherein the one or more particulates comprise iron, one or more iron oxides, or a mixture thereof, and wherein the purified particulate product is recovered.

20. The method according to any one of paragraphs 12 to 18, wherein the one or more particulates comprise phosphorus, one or more phosphorus oxides, or a mixture thereof, and wherein the purified particulate product is recovered.

21. The method according to any one of paragraphs 12 to 18, wherein the one or more particulates comprise silica, and wherein the purified particulate product is recovered.

22. The method according to any one of paragraphs 12 to 21, wherein the liquid in the liquid suspension comprises water.

23. The method according to any one of paragraphs 12, 13, or 15 to 22, wherein the liquid suspension further comprises one or more contaminants, and wherein the purified particulate product is recovered, and wherein the purified particulate product has a reduced concentration of the liquid and the one or more contaminants relative to the treated mixture.

24. The method according to any one of paragraphs 12 to 23, wherein the liquid suspension or slurry is further contacted with one or more depressants, one or more frothing agents, or a mixture thereof to produce the treated mixture.

25. The method according to any one of paragraphs 12, 13, or 15 to 24, wherein the one or more particulates comprises a mixture of a first particulate material and a second particulate material, wherein the first particulate material is selected from the group consisting of: phosphate, potash, lime, sulfate, gypsum, iron, platinum, gold, palladium, titanium, molybdenum, copper, uranium, chromium, tungsten, manganese, magnesium, lead, zinc, clay, coal, silver, graphite, nickel, bauxite, borax, borate, and bitumen, wherein the second particulate material is selected from the group consisting of: sand and clay, and wherein the purified particulate product is recovered and comprises the first particulate material having a reduced concentration of the liquid and a reduced concentration of the second particulate material relative to the treated mixture.

26. The method according to any one of paragraphs 12, 13, or 15 to 24, wherein the one or more particulates comprise a mixture of a first particulate material and a second particulate material, wherein the first particulate material comprises iron, one or more iron oxides, or a mixture thereof, and wherein the second particulate material comprises sand, clay, or a mixture thereof, and wherein the purified particulate product is recovered and comprises the first particulate material having a reduced concentration of the liquid and a reduced concentration of the second particulate material relative to the treated mixture.

27. The method according to any one of paragraphs 14 to 18, 22, or 24, wherein the value material comprises iron, one or more iron oxides, phosphorus, one or more phosphorus oxides, or any mixture thereof, and wherein the contaminant comprises silica.

28. A collector composition comprising: one or more amidoamines having formula (I):

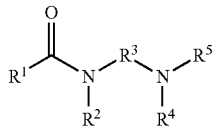

(I)

where $R^1$ can be a $(C_1\text{-}C_{24})$alkyl, a $(C_1\text{-}C_{24})$alkenyl, or a $(C_1\text{-}C_{24})$dialkenyl; $R^2$ and $R^3$ can independently be selected from a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, and an aryl substituted by one or more substituents selected from halogens, $(C_1\text{-}C_6)$alkyls, and halogen-$(C_1\text{-}C_6)$alkyls; and $R^4$ and $R^5$ can be independently selected from a hydrogen and a $(C_1\text{-}C_6)$alkyl, and one or more etheramines having formula (II):

$$R^6\text{—O—}R^7\text{—}NH_2 \quad \text{(II)}$$

where $R^6$ can be a hydrogen, a $(C_1\text{-}C_{18})$alkyl, a halogen-$(C_1\text{-}C_{18})$alkyl, a phenyl, a $(C_1\text{-}C_6)$alkenyl, a heterocyclyl, an unsubstituted aryl, or an aryl substituted by one or more substituents selected from halogens, $(C_1\text{-}C_{18})$alkyls, and halogen-$(C_1\text{-}C_{18})$alkyls; and $R^7$ can be a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, or an aryl substituted by one or more substituents selected from halogens, $(C_1\text{-}C_6)$alkyls, and halogen-$(C_1\text{-}C_6)$alkyls, or one or more etheramines having formula (III):

$$R^8\text{—O—}R^9\text{—NH—}R^{10}\text{—}NH_2 \quad \text{(III)}$$

where $R^8$ can be a hydrogen, a $(C_1\text{-}C_{18})$alkyl, a halogen-$(C_1\text{-}C_{18})$alkyl a phenyl, a $(C_1\text{—}, C_{18})$alkenyl, a heterocyclyl, an unsubstituted aryl, or an aryl substituted by one or more substituents selected from halogens, $(C_1\text{-}C_{18})$alkyls, and halogen-$(C_1\text{-}C_{18})$alkyls; and $R^9$ and $R^{10}$ can independently be selected from a hydrogen, a $(C_1\text{-}C_6)$alkyl, a halogen-$(C_1\text{-}C_6)$alkyl, a phenyl, a $(C_1\text{-}C_6)$alkenyl, a heterocyclyl, an unsubstituted aryl, and an aryl substituted by one or more substituents selected from halogens, $(C_1\text{-}C_6)$alkyls, and halogen-$(C_1\text{-}C_6)$alkyls.

29. The composition according to paragraph 28, wherein the amidoamine is made by reacting tall oil fatty acids and one or more polyamines.

30. The composition according to paragraph 28, wherein the amidoamine is made by reacting one or more carboxylic acids and one or more polyamines.

31. The composition according to paragraph 29 or 30, wherein the polyamine is diethylenetriamine, 1,3-diaminopentane, or a mixture thereof.

32. The composition according to any one of paragraphs 28 to 31, wherein the weight ratio of the amidoamine to the etheramine is from about 35:65 to about 65:35.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A process for beneficiation of an iron-containing ore, comprising:

contacting an aqueous suspension or slurry comprising an ore with a collector to produce a treated mixture, wherein:

the ore comprises iron and silica, the collector comprises a mixture of an amidoamine and an etheramine, the amidoamine comprises a reaction product of a tall oil fatty acid and a polyamine, the polyamine comprises diethylenetriamine, 1,3-diaminopentane, or a mixture thereof, and the mixture of the amidoamine and the etheramine has a weight ratio of the amidoamine to the etheramine of about 35:65 to about 65:35; and recovering a purified iron product from the treated mixture, wherein the purified iron product has a reduced concentration of the silica relative to the treated mixture.

2. The process of claim 1, wherein the iron comprises iron oxide.

3. The process of claim 1, wherein the treated mixture has a pH of about 8 to about 11.

4. The process of claim 1, wherein the weight ratio of the amidoamine to the etheramine is about 35:65.

5. The process of claim 1, wherein the polyamine comprises diethylenetriamine.

6. The process of claim 1, wherein the polyamine comprises 1,3-diaminopentane.

7. The process of claim 1, the treated mixture comprises about 1 gram of the collector per tonne of ore to about 120 grams of the collector per tonne of ore.

8. The process of claim 1, the treated mixture comprises about 1 gram of the collector per tonne of ore to about 100 grams of the collector per tonne of ore, and wherein the purified iron product comprises less than 2 wt % of the silica, based on a solids weight of the purified iron product.

9. The process of claim 1, further comprising passing air through the treated mixture.

10. The process of claim 1, further comprising contacting the aqueous suspension or slurry with a depressant to produce the treated mixture, wherein the depressant comprises a modified starch, carboxymethyl cellulose, gum arabic, or any mixture thereof.

11. The process of claim 1, further comprising contacting the aqueous suspension or slurry with a frothing agent to produce the treated mixture, wherein the frothing agent comprises methyl isobutyl carbinol, a polypropylene glycol alkyl ether, a polypropylene glycol phenyl ether, or any mixture thereof.

12. A process for beneficiation of an iron-containing ore, comprising:

adding a collector to an aqueous suspension or slurry comprising an ore to produce a treated mixture, wherein:

the ore comprises iron and silica, the collector comprises about 60 wt % to about 70 wt % of an etheramine and about 30 wt % to about 40 wt % of an amidoamine, based on a combined weight of the etheramine and the amidoamine, the amidoamine comprises a reaction product of a tall oil fatty acid and a polyamine, the polyamine comprises diethylenetriamine, 1,3-diaminopentane, or a mixture thereof, the treated mixture has a pH of about 8 to about 11, and the treated mixture comprises about 30 grams of the collector per tonne of ore to about 120 grams of the collector per tonne of ore;

subjecting the treated mixture to froth flotation; and recovering a purified iron product from the treated mixture, wherein the purified iron product has a reduced concentration of the silica relative to the treated mixture.

13. The process of claim 12, wherein the polyamine comprises diethylenetriamine.

14. The process of claim 12, wherein the polyamine comprises 1,3-diaminopentane.

15. The process of claim 12, wherein the iron comprises iron oxide.

16. The process of claim 12, wherein the purified iron product comprises less than 2 wt % of the silica, based on a solids weight of the purified iron product.

17. The process of claim 12, the treated mixture comprises about 50 grams of the collector per tonne of ore to about 90 grams of the collector per tonne of ore.

18. The process of claim 12, further comprising adding a depressant to the aqueous suspension or slurry to produce the treated mixture, wherein the depressant comprises a modified starch, carboxymethyl cellulose, gum arabic, or any mixture thereof.

19. The process of claim 12, further comprising adding a frothing agent to the aqueous suspension or slurry to produce the treated mixture, wherein the frothing agent comprises methyl isobutyl carbinol, a polypropylene glycol alkyl ether, a polypropylene glycol phenyl ether, or any mixture thereof.

20. A process for beneficiation of an iron-containing ore, comprising:

adding a collector and at least one of a depressant and a frothing agent to an aqueous suspension or slurry comprising an ore to produce a treated mixture, wherein:

the ore comprises iron and silica, the collector comprises about 60 wt % to about 70 wt % of an etheramine and about 30 wt % to about 40 wt % of an amidoamine, based on a combined weight of the etheramine and the amidoamine, the amidoamine comprises a reaction product of a tall oil fatty acid and a polyamine, the polyamine comprises diethylenetriamine, 1,3-diaminopentane, or a mixture thereof, the depressant comprises a modified starch, carboxymethyl cellulose, gum arabic, or any mixture thereof, the frothing agent comprises methyl isobutyl carbinol, a polypropylene glycol alkyl ether, a polypropylene glycol phenyl ether, or any mixture thereof, the treated mixture has a pH of about 8 to about 11, and the treated mixture comprises about 60 grams of the collector per tonne of ore to about 90 grams of the collector per tonne of ore;

subjecting the treated mixture to froth flotation; and recovering a purified iron product from the treated mixture, wherein the purified iron product has a reduced concentration of the silica relative to the treated mixture, and wherein the purified iron product comprises less than 2 wt % of the silica, based on a solids weight of the purified iron product.

* * * * *